US005521585A

United States Patent [19]

Hamilton

[11] Patent Number: 5,521,585

[45] Date of Patent: May 28, 1996

[54] PROTECTOR

[76] Inventor: Albert L. Hamilton, 3516 Cortez, Dallas, Tex. 75220

[21] Appl. No.: 383,294

[22] Filed: Feb. 2, 1995

[51] Int. Cl.[6] ..... G08B 17/10

[52] U.S. Cl. ..... 340/628; 340/693; 340/542; 340/584; 49/31; 49/141

[58] Field of Search ..... 340/628, 542, 340/693, 543, 584, 578, 577, 579; 70/280, 279; 49/31, 56, 141

[56] References Cited

U.S. PATENT DOCUMENTS

| | | | |
|---|---|---|---|
| 4,286,305 | 8/1981 | Pilat et al. | 70/280 |
| 4,415,893 | 11/1983 | Roland et al. | 340/543 |
| 4,452,010 | 6/1984 | Whittington et al. | 49/141 |
| 4,539,555 | 9/1985 | Tefka | 340/584 |
| 4,685,316 | 8/1987 | Hicks et al. | 49/141 |
| 4,837,560 | 6/1989 | Newberry | 340/578 |

*Primary Examiner*—John K. Peng
*Assistant Examiner*—Benjamin C. Lee
*Attorney, Agent, or Firm*—Michael I. Kroll

[57] ABSTRACT

A life saving system that allows escape from secured premises is provided. The system includes door/window locks that are normally held in the locked position by the presence of an electrical current through solenoids contained in the locks. When an accessory fire/smoke alarm is activated, current through the solenoids is interrupted, thereby automatically unlocking the doors or windows. Uninterruptable power supplies are provided that can operate from alternating current or direct current sources. Additional security is provided by an optional key lock shunt box that prevents tampering by unauthorized users.

1 Claim, 2 Drawing Sheets

PROTECTOR

BACKGROUND OF THE INVENTION

The instant inventions relates, generally, to the field of security systems, and, more specifically, to protective systems that unlock secured doors and windows when fire or smoke alarms are.

A major cause of death and injury in residential and commercial fires is the trend toward securing premises through the installation of door and window locks and bars. When a fire breaks out, the presence of such locks may seriously impede or even block egress. Even if smoke and fire alarms provide early warning, death or injury may result.

SUMMARY OF THE INVENTION

It is, therefore, a primary object of the present invention to provide the protector, a life saving system that allows from secured premises.

A further object is to provide a life saving system that operates even if the power is turned off.

A yet further object is to provide a life saving system that automatically unlocks doors and windows when a smoke or fire alarm is activated.

A further object is to provide a life saving system that cannot be deactivated by an intruder or other unauthorized persons.

A still further object is to provide a life saving system that is simple and inexpensive to install, operate, and maintain.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

COMPONENT LIST

| NUMERAL | DESCRIPTION |
|---|---|
| 12 | AC Power Supply - Breaker Panel |
| 14 | AC Power Supply - Rectifier |
| 16 | AC Power Supply - Trickle Charge Circuit |
| 18 | AC Power Supply - Backup Battery |
| 20 | AC Power Supply - Buzzer Maintenance Resistor |

-continued

COMPONENT LIST

| NUMERAL | DESCRIPTION |
|---|---|
| 22 | AC Power SuppIV - Key Shunt Lock Box |
| 24 | DC Power Supply - Breaker Panel |
| 26 | DC Power Supply - Inverter |
| 28 | DC Power Supply - Rectifier |
| 30 | DC Power Supply - Trickle Charge Circuit |
| 32 | DC Power Supply - Backup Battery |
| 34 | DC Power Supply - Buzzer Maintenance Resistor |
| 36 | DC Power Supply - Key Lock Shunt Box |
| 38 | Smoke/Fire Alarm Relay Coil |
| 40 | Smoke/Fire Alarm Relay Normally Closed Contacts |
| 42 | Door/Window Solenoid #1 |
| 44 | Door/Window Solenoid #2 |
| 46 | Door/Window Solenoid #3 |
| 48 | Door/Window Solenoid #4 |
| 50 | Door/Window Solenoid #5 |
| 52 | Door/Window Solenoid #n-1 |
| 54 | Door/Window Solenoid #n |
| 56 | Typical Window - Fixed Pane |
| 58 | Typical Window - Moveable Pane |
| 60 | Typical Door/Window Solenoid Lock |
| 62 | Door/Window Solenoid Lock - Coil |
| 64 | Door/Window Solenoid Lock - Plunger Return Spring |
| 66 | Door/Window Solenoid Lock - Plunger |

DETAILED DESCRIPTION OF THE PREFERRED EMBODIMENTS

The protector, a life saving system that allows escape from secured premises, can be operated from either alternating current or direct current. The operating from alternating current can best be understood with reference to FIG. 1, while the operation from direct current can best be understood with reference to FIG. 2.

Figure 1:
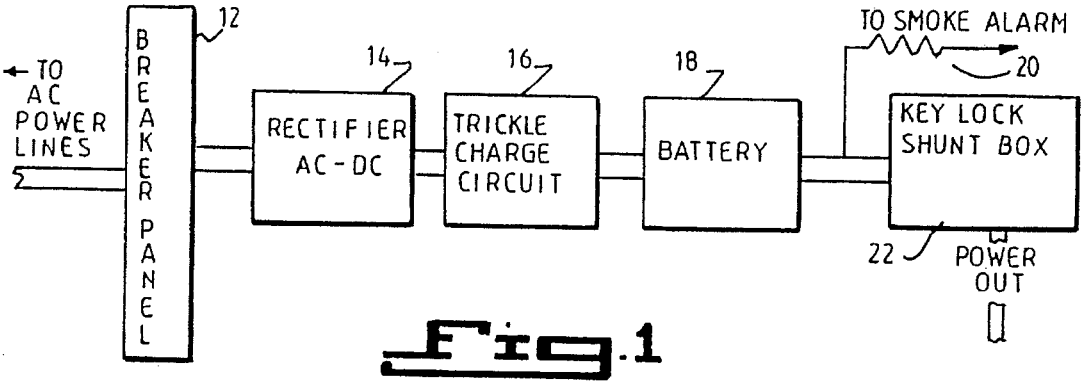
FIG. 1 is an electronic block diagram of the power supply system of the invention where the power source is alternating current.

In FIG. 1, alternating current is distributed by breaker panel 12. A dedicated breaker supplies the system. Alternating current from breaker panel 12 is input to rectifier 14 which converts the alternating current to direct current. A trickle charge circuit 16 keeps battery 18 in a high state of charge. Power to the system is supplied through optional key lock shunt box 22 which prevents tampering by unauthorized personnel. A smoke alarm resistor 20 is provided to keep the conventional fire alarm buzzer activated when the protector system is activated.

Figure 2:
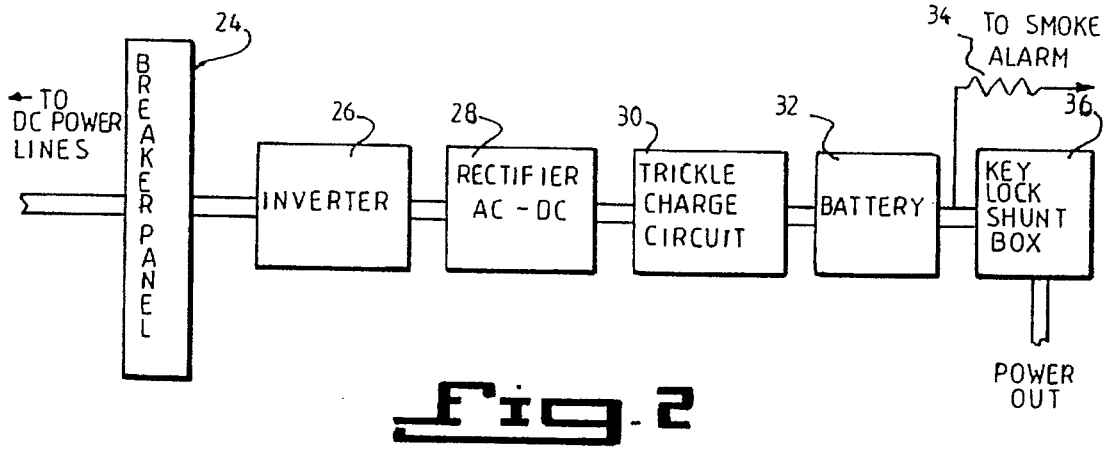
FIG. 2 is an electronic block diagram of the power supply system of the invention where the power source is direct current.

In FIG. 2, direct current is distributed by breaker panel 24. A dedicated breaker supplies the system. Direct current from breaker panel 24 is input to inverter 26 which converts the direct current to alternating current. The output of inverter 26 is input to rectifier 28 which converts the alternating current to direct current. A trickle charge circuit 30 keeps battery 32 in a high state of charge. Power to the system is supplied through optional key lock shunt box 36 which prevents tampering by unauthorized personnel. A smoke alarm resistor 34 is provided to keep the conventional fire alarm buzzer activated when the protector system is activated.

Figure 3:
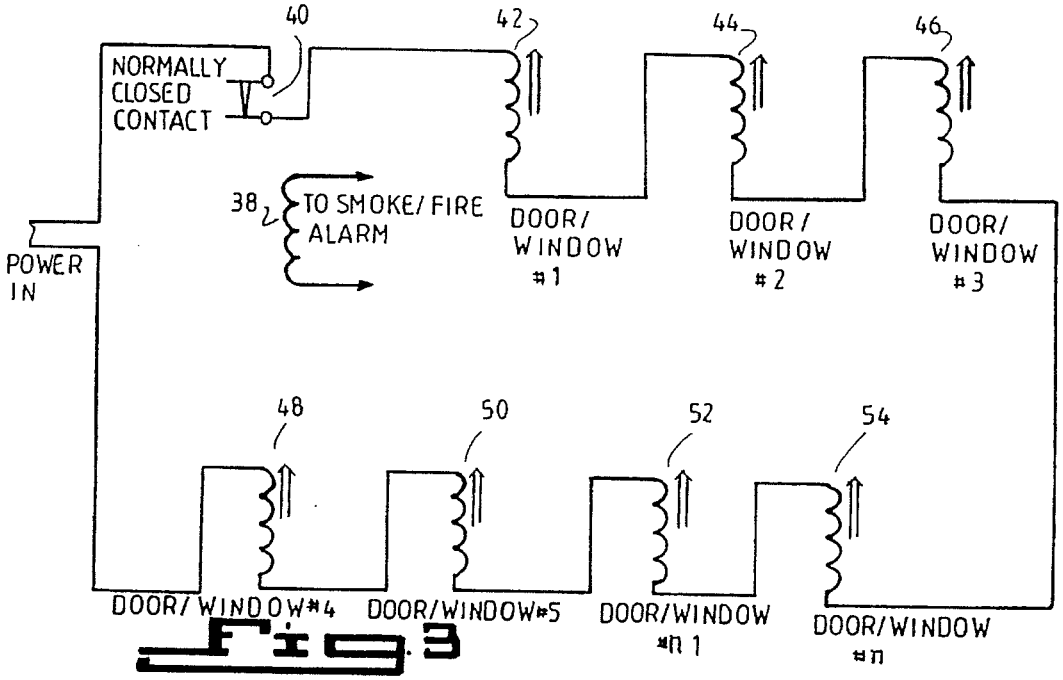
FIG. 3 is an electronic schematic diagram of the invention showing door and window mounted solenoid locks.

The remainder of the system is best understood with reference to FIG. 3. Power to the door alarm switches is controlled by relay 38/40. The coil 38 is connected to a conventional smoke/fire alarm such that when the alarm is activated power is supplied to the coil. In normal operation, power is applied through normally closed relay contact 40 to the door window locks such as door/window lock #1 (42), door/window lock #2 (44), door/window lock #3 (48), door/window lock #4 (48), door/window lock #5 (50), door/window lock #n-1 (52), and door/window lock #n (54). These door/window locks are shown connected in series; however, they could also be connected in parallel, although the series connection simplifies wiring and reduces the amount of wire needed. When the conventional smoke/fire alarm is activated, power is applied to coil 38, and normally closed contact 40 is activated thereby disconnecting power from all of the door/window locks thereby unlocking all the door and windows.

Figure 4:
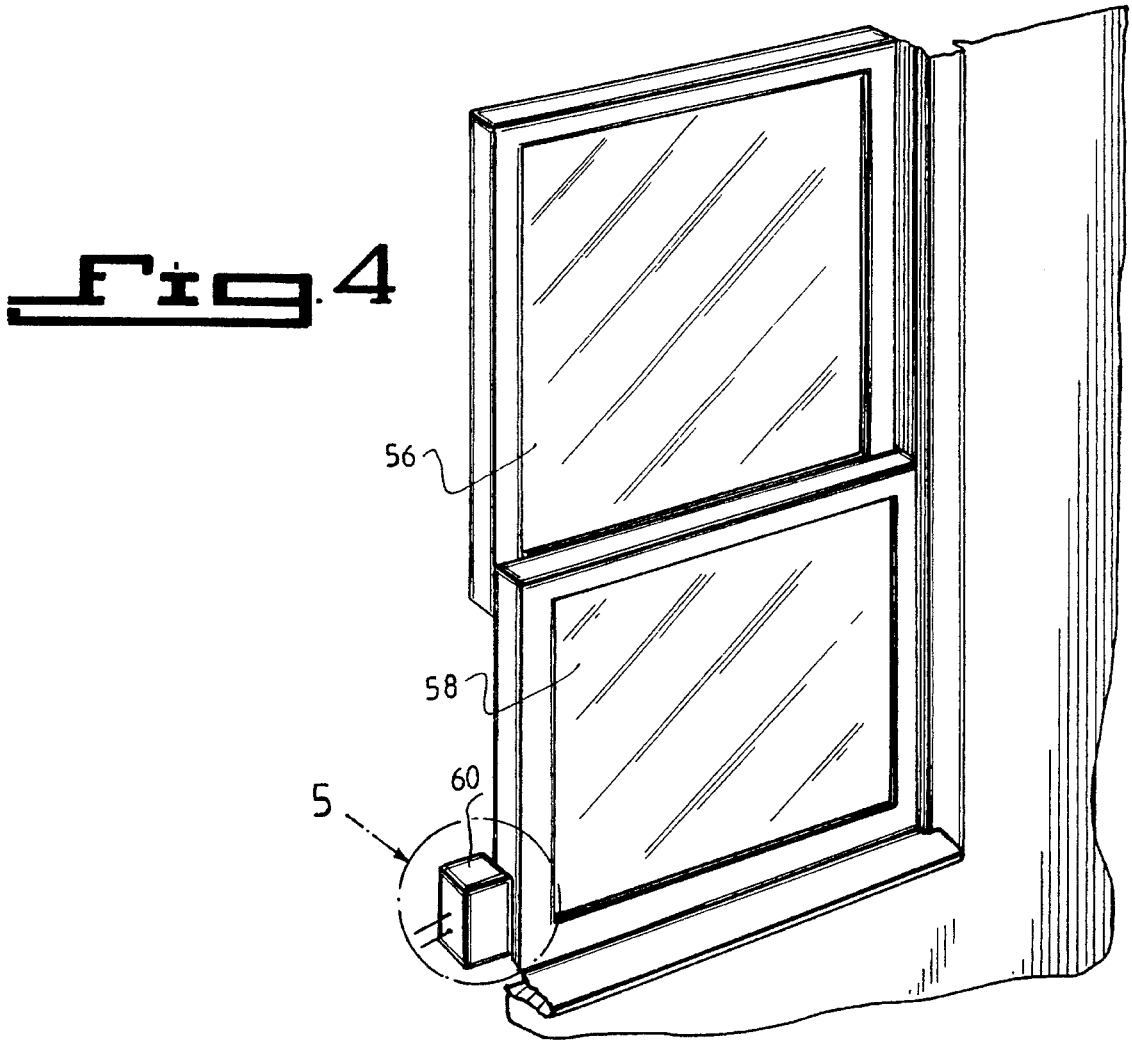
FIG. 4 is a view of the invention showing a window mounted solenoid installed thereto.
Figure 5:
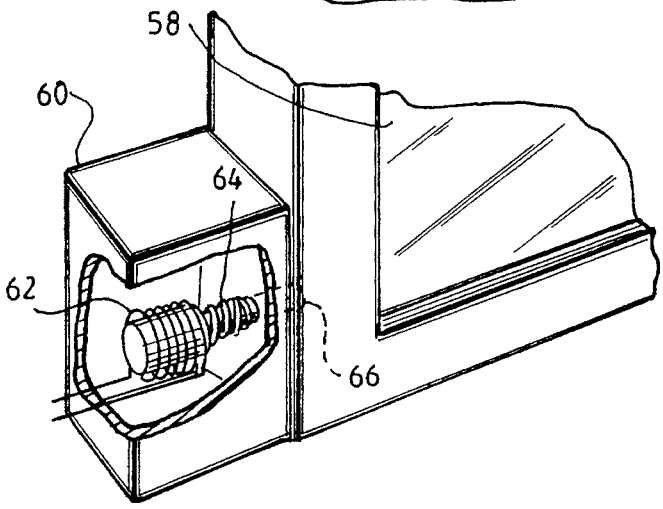
FIG. 5 is a detailed view of the window mounted solenoid, highlighted in FIG. 4, showing the solenoid components.

This unlocking process Is best understood with reference to FIGS. 4 and 5. The typical window shown has a fixed pane 56 and a moveable pane 58. The operation of the window lock 60 is best understood with reference to FIG. 5. A plunger 66 projects into a recess in moveable pane 58 when power is applied to coil 62. A retraction spring 64 automatically withdraws plunger 66 when power is removed, thereby providing a fail safe method of unlocking the window.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A life saving system allowing escape from secured premises windows and doors comprising:

a. an uninterrupted power source comprising a battery and trickle charge means for maintaining said battery fully charged;

b. a conventional smoke/fire alarm;

c. lock means for each of the windows and doors on said premises for locking said doors and windows powered by said battery, said lock means including solenoid means for each said doors and windows energized by said battery to maintain said windows and doors in a locked position when receiving electrical power from said battery;

d. normally closed relay means in series with said solenoid means for maintaining said solenoid means energized and said lock means in a locked position;

e. key lock means between said battery and said lock means for permitting a key to be used to interrupt electrical power to said lock means for unlocking said windows and doors;

f. automatic means for causing said normally closed relay means to open and interrupt power flow from said battery to said lock means upon activation of said smoke/fire alarm, the interruption of power causing deenergization of said solenoid means and unlocking of said windows and doors; and g. means to keep the smoke/fire alarm activated when said automatic means causes interruption of power flow to said lock means.

* * * * *